United States Patent [19]

Baxter

[11] Patent Number: 4,775,064

[45] Date of Patent: Oct. 4, 1988

[54] GUARANTEE BAND FOR A CONTAINER CLOSURE

[75] Inventor: Alan A. Baxter, Colchester, United Kingdom

[73] Assignee: National Plastics Limited, United Kingdom

[21] Appl. No.: 99,256

[22] Filed: Sep. 21, 1987

[30] Foreign Application Priority Data

Sep. 25, 1986 [GB] United Kingdom ..... 8623065

[51] Int. Cl.[4] ..... B65D 41/34

[52] U.S. Cl. ..... 215/230; 215/252

[58] Field of Search ..... 215/252, 230

[56] References Cited

U.S. PATENT DOCUMENTS

| | | | |
|---|---|---|---|
| 4,493,427 | 1/1985 | Wolkonsky | 215/252 X |
| 4,527,705 | 7/1985 | Prades | 215/252 |
| 4,530,436 | 7/1985 | Wiedmer | 215/252 X |
| 4,638,917 | 1/1987 | Persch | 215/252 |
| 4,700,859 | 10/1987 | Gregory | 215/252 |

*Primary Examiner*—Donald F. Norton

*Attorney, Agent, or Firm*—Emrich & Dithmar

[57] ABSTRACT

A guarantee band for a container closure is connected to an adjacent element of the closure by a breakable separating section having a part stronger than the remainder of the section. The guarantee band has at least two weakened regions spaced around its periphery, one of said weakened regions being weaker than the other or others and the said weaker region being located near to said stronger section part. On removing the closure from a suitable container for the first time, the guarantee band will break at the said weaker region, the breakable separating section will break except at the stronger section part and the remaining weaker region or regions will each provide an articulation causing the guarantee band to adopt a drooping configuration to give an enhanced indication of breakage of the guarantee band.

14 Claims, 3 Drawing Sheets

GUARANTEE BAND FOR A CONTAINER CLOSURE

TECHNICAL FIELD

This invention relates to a guarantee band for a container closure, that is a band which, attached to a closure, will engage below a bead formed around a container neck, when the closure is applied to the container, and which is so formed that it cannot subsequently be removed from the container without breaking the band and/or breaking the connection of the band to the closure or a part connected to the closure. Thus, the fact that the guarantee band, and therefore the closure to which it is attached, has been removed from the container becomes visible and such bands are sometimes known as tamper-indicating bands.

The object of the present invention is to provide a guarantee band adapted to show more reliably and more clearly than some previous guarantee bands that the band has been broken.

SUMMARY OF THE INVENTION

With this object in view, a guarantee band according to the invention is connected to an adjacent element of the closure by a breakable separating section having a part stronger than the remainder of the section; further, the guarantee band has at least two weakened regions spaced around its periphery, one of the weakened regions being weaker than the other or others and the said weaker region being located near to the said stronger section part, so that on removing a closure with the guarantee band attached from a suitable container for the first time, the guarantee band will break at the said weaker region, the breakable separating section will break except the stronger section part, and the remaining weaker region or regions will each provide an articulation, the arrangement allowing the guarantee band to adopt a drooping configuration in relation to the container to give an enhanced indication of breakage of the guarantee band.

Weakening of one of the weakened regions of the guarantee band may be achieved by forming the region as a thinner connecting web between thicker sections of the guarantee band and, if the other weakened region or regions are also constituted by connecting webs, the region which is to be weaker may be formed thinner and/or shorter than the other region or regions. If only two weaker regions are present in the guarantee band they may be diametrically oppositely located around the band.

The stronger section part may be immediately adjacent the said weaker region of the guarantee band.

The guarantee band may be formed in one piece with the cap part of a container closure or may be one element of an insert, the other adjacent element of which is attachable to the cap part of a container closure.

The breakable separating section connecting the guarantee band to an adjacent element of a container closure may be constituted by a number of connecting bridges disposed at intervals around the guarantee band and one of which is stronger than the others.

BRIEF DESCRIPTION OF DRAWINGS

The invention will be further described, by way of example, with reference to the accompanying drawings in which.

DESCRIPTION OF PREFERRED EMBODIMENT

Figure 1:
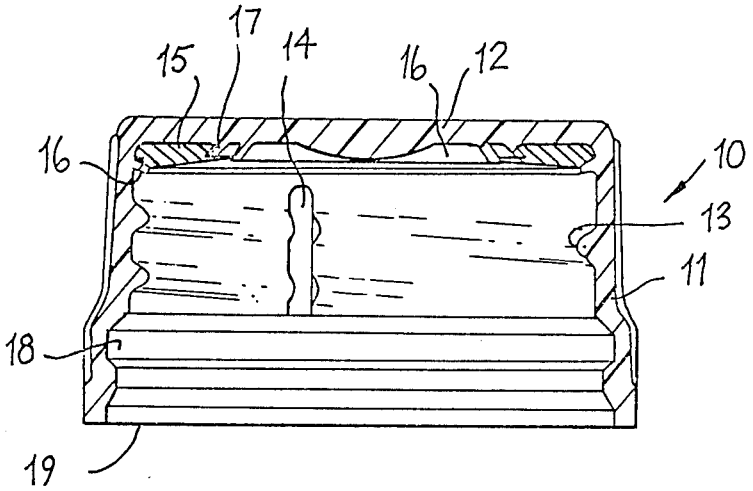
FIG. 1 is a longitudinal section through the cap part of a container closure.

The container closure illustrated in the drawings is made by injection moulding in for example polypropylene and/or polyethylene and comprises a cap part 10 (FIG. 1) having a side wall 11 and an end wall 12. The side wall 11 is formed internally with a screw thread 13, for engagement with a corresponding screw thread on the neck of a container, and is also formed with a slot 14 to relieve the pressure in a container during unscrewing of the closure. The end wall 12 carries a gasket 15 formed of material introduced into the cap part 10 in liquid form and retained after curing and solidification by formations 16 and 17 on the internal surface of the end wall 12, formations 16 comprising annular elements and formations 17 a series of discrete retaining elements upstanding from the inner surface of the end wall and located at intervals around it.

Figure 2:
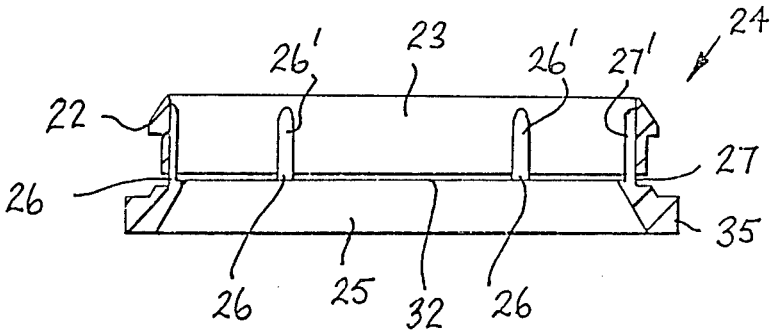
FIG. 2 is a longitudinal section through an insert, including a guarantee band, for attachment to the cap part of FIG. 1.
Figure 3:
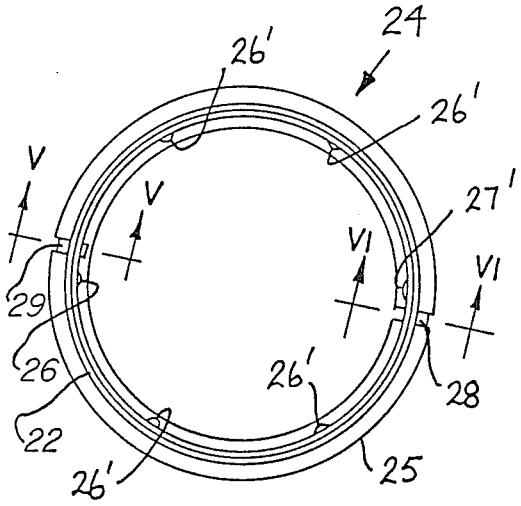
FIG. 3 is a view of the insert of FIG. 2 from above.
Figure 4:
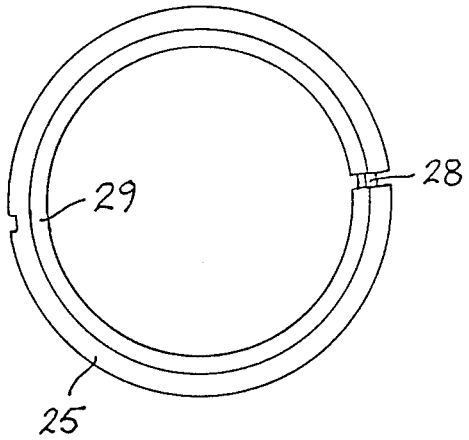
FIG. 4 is a view of the insert of FIG. 2 from below.

An annular recess 18 formed internally on the side wall 11 near its lower rim 19 is adapted to receive an annular projection 22 formed externally of an annular upper element 23 of an insert 24 (FIG. 2), the interengagement of the annular projection 22 and the annular recess 18 serving to attach the insert 24 to the cap part 10 of the closure when the element 23 of the insert 24 is pushed into the cap part 10.

The insert 24 also comprises another element, adjacent the element 23, and constituted by a guarantee band 25 which is connected to the element 23 by a breakable separating section constituted, in this example, by a number of (in fact six) connecting bridges 26 and 27 (FIGS. 2, 3, 5 and 6). Each connecting bridge 26 or 27 is a continuation of an associated rib 26' or 27' extending axially of the element 23. The centre lines of the ribs 26' and 27' are spaced equidistantly, at angular intervals of 60° around the element 23 and the connecting bridges 26 and 27 are thus spaced at equal angular distances of 60° around the guarantee band 25. The ribs 26' and 27' serve to engage the neck 37 of a container, (FIG. 5) and thus resist any tendency of the projection 22 to spring out of the recess 18.

The ribs 26' and the bridges 26 are each approximately 1 mm wide and the inner surface of each is part of a cylindrical surface. The rib 27' and the bridge 27 is approximately 3 e mm wide and the inner surface of each is part of a cylindrical surface. Thus, the bridge 27 is stronger than the bridges 26. The cap part 10 in the present example has a diameter, in its widest region, of approximately 33 mm.

The guarantee band 25 has two weakened regions at diametrically opposed locations (in this example) around its circumference. The weakened regions are formed as connecting webs 28 and 29. In the present example, the web 28 has a thickness of 0.075 mm and its depth (measured in the direction from top to bottom of the guarantee band) is less than that of the web 29 which has a depth equal to that of the remainder of the guarantee band and a thickness of 0.15 mm. The web 28 is thus less than half as strong as the web 29 since it is only half as thick and has a smaller depth. Further, the weaker web 28 is located immediately adjacent the stronger bridge 27.

The guarantee band 25 has an inwardly projecting lip 32, the upper surface 33 of which is upwardly and inwardly inclined with respect to the insert 24 and in this example in fact is at an angle of 15° to a plane 34 at right angles to the axis of the insert 24. The guarantee band has a thickened outwardly projecting lower rim 35 corresponding to the outer diameter of the lower rim of the cap part 10 and providing, as well as an aesthetically satisfactory feature a desirable strength in the guarantee band.

Figure 5:
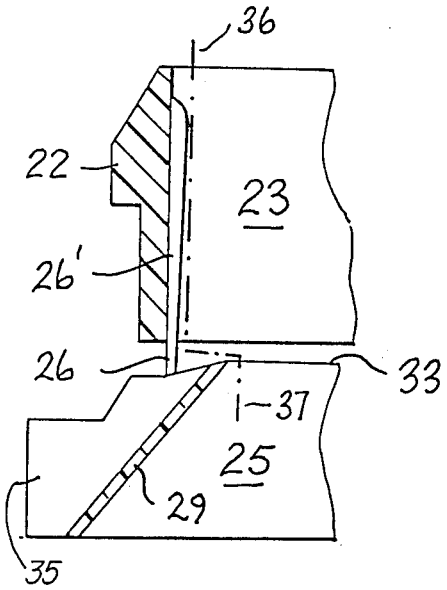
FIGS. 5 and 6 are sections on the lines V—V and VI—VI, respectively, of FIG. 3 on an enlarged scale.
Figure 6:
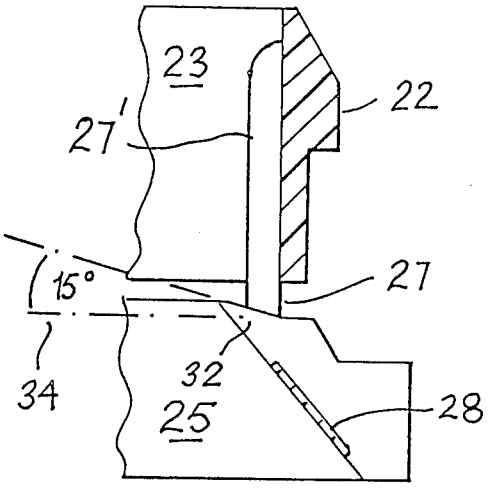

The projecting lip 32 engages, when the closure is applied to a container, (the insert 24 having been inserted into the cap part 10) beneath a protruding bead 36 on the container neck 37 (part of which is shown in FIG. 5) so that the guarantee band 25 cannot be removed from the container without breaking it. In fact, after application of the closure to a suitable container (with a protruding bead) on first removal of the closure, the guarantee band 25 and the bridges 26 will break leaving the broken guarantee band attached to the element 23 by the stronger bridge 27. If the closure is then replaced on the container and the container is disposed in its normal, upright condition, the guarantee band will tend to adopt a drooping configuration in relation to the container, falling downwardly on the container neck in the direction around the container from the bridge 27 towards the free end of the broken guarantee band. Further, the stronger of the two weakened regions of the guarantee band constituted by the web 29 will serve as an articulation allowing the part of the guarantee band on the side of the web 29 remote from the bridge 27 (proceeding in the direction towards the free end of the broken guarantee band) to droop even more markedly in relation to the container. Thus the guarantee band will give an enhanced indication of breakages.

The two weakened regions of the guarantee band need not be diametrically opposite one another but the weaker of the weakened regions should be near the stronger bridge to encourage breakage of the guarantee band at this weaker region and to enhance the drooping action. More than two weakened regions may be provided but one of these regions must be sufficiently weaker than the others to make breakage at the weaker region likely.

The breakable separating section may be constituted by a tearable web extending around the insert 24 and joining the guarantee band 25 and the element 23 together. This web must then have a stronger, for example a thicker, portion not easily tearable to ensure retention of the broken guarantee band on the element 23 and cap part 10.

An additional advantage of providing weakened regions in the guarantee band, especially thin webs such as those described above, is that they allow the guarantee band to expand slightly on application to a container, when the guarantee band has to pass over the retaining bead 36 on the container 37, thus reducing the risk of breaking the connecting bridges 26 and 27 on application.

Figure 7:
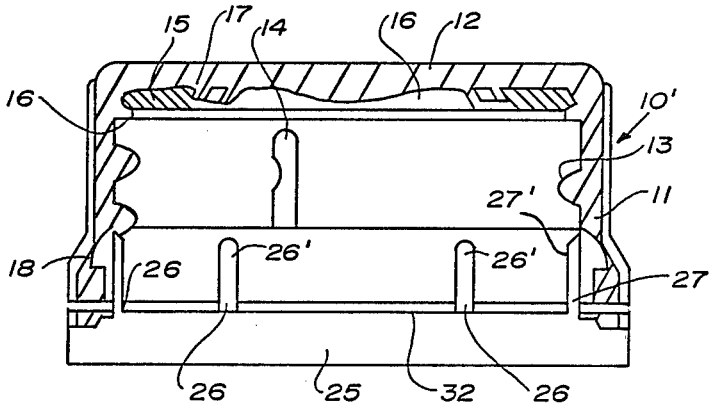
FIG. 7 is a longitudinal section though a container closure in which the guarantee band is formed integrally with the cap part of the closure.

Referring to FIG. 7, there is illustrated a further embodiment of a container closure wherein the guarantee band 25 is formed integrally with the cap part 10'.

Although the insert including the guarantee band 25 may be formed in one piece with the cap part 10' of the closure, as shown in cap part 10' in FIG. 7, this will almost always involve the use of a split mould with a collapsible core and is not preferred.

We prefer to separately fabricate the cap part 10 and the insert 25, since this enables different plastics materials to be used for each. The cap part needs to be strong to provide good pressure-resisting properties in use and desirably also has a sufficiently high heat distortion temperature to permit an appropriate flowed-in gasket material to be used and heat treated in the cap part. Polypropylene is a suitable material for the cap part 10. The insert 25 needs to be flexible enough to stretch without breaking over the bead 36 on the container neck on first application and low density polyethylene is a particularly preferred material for the insert.

Separate fabrication of the parts 10 and 25 can also be desirable if a colour contrast is desired between the cap part and the guarantee band 25.

What is claimed is:

1. A guarantee band for a container closure having a cap part, said guarantee band including a breakable separating section connecting said guarantee band to a closure, said breakable separating section having a part stronger than the remainder of the section, wherein the quarantee band has at least two weakened regions spaced around its periphery, one of said weakened regions being weaker than the other and the said weaker region being located near to said stronger section part, so that on removing the closure from a suitable container for the first time, the guarantee band will break at the said weaker region, the breakable separating section will break except at the stronger section part and the remaining weaker region will each provide an articulation causing the guarantee band to adopt a drooping configuration to give an enhanced indication of breakage of the guarantee band.

2. A guarantee band as claimed in claim 1, wherein said weakened regions of the guarantee band are produced by forming each of said regions as a thinner connecting web between thicker sections of the guarantee band and wherein said connecting web of said one weakened region is constituted by a web which is thinner than and is shorter, measured in a direction from top to bottom of the guarantee band, than the connecting web of the other weakened region.

3. A guarantee band as claimed in claim 2, wherein only two weakened regions are present and are located at diametrically opposed positions around the guarantee band.

4. A guarantee band as claimed in claim 2, wherein said stronger section part is immediately adjacent said weaker region of the guarantee band.

5. A guarantee band as claimed in claim 1, wherein only two weakened regions are present and are located at diametrically opposed positions around the guarantee band.

6. A guarantee band as claimed in claim 5, wherein said stronger section part is immediately adjacent said weaker region of the guarantee band.

7. A guarantee band as claimed in claim 1, wherein said stronger section part is immediately adjacent said weaker region of the guarantee band.

8. A guarantee band as claimed in claim 1 and formed in one piece with the cap part of a container closure.

9. A guarantee band as claimed in claim 1 and formed with a mounting element portion defining an insert, which is attachable to the cap part of a container closure.

10. A guarantee band as claimed in claim 9, wherein the insert is made of a plastics material flexible enough to stretch without breaking over a bead of a container neck on first application of the closure to a container.

11. A guarantee band as claimed in claim 1, wherein said breakable separating section is constituted by a number of connecting bridges disposed at intervals around the guarantee band and one of which is stronger than the others.

12. A container closure including a cap part and an insert attachable to said cap part, said insert including a mounting element portion and guarantee band including a breakable separating section connecting said guarantee band to said mounting element portion, said breakable section having a part stronger than the remainder of the section, wherein the guarantee band has at least two weakened regions spaced around its periphery, one of said weakened regions being weaker than the other and the said weaker region being located near to said stronger section part, so that on removing the closure from a suitable container for the first time, the guarantee band will break at the said weaker region, the breakable separating section will break except at the stronger section part and the remaining weaker region will each provide an articulation causing the guarantee band to adopt a drooping configuration to give an enhanced indication of breakable of the guarantee band.

13. A container closure as claimed in claim 12, wherein the insert and cap part are made of materials providing a colour contrast.

14. A container closure according to claim 12, wherein said insert is made of a plastics material flexible enough to stretch without breaking over a bead of a container neck of a first application of the container closure to a container, and in that the cap part is made of a plastics material having good pressure-resisting properties in use and a sufficiently high heat distortion temperature to permit a gasket material to be flowed in and heat treated in the cap part

* * * * *